US005142759A

United States Patent [19]

Bonander et al.

[11] Patent Number: 5,142,759

[45] Date of Patent: Sep. 1, 1992

[54] ROLL COVER APPARATUS

[75] Inventors: James Bonander, Clarks Summitt; Charles W. Jaget, Susquehanna, both of Pa.

[73] Assignee: Beloit Corporation, Beloit, Wis.

[21] Appl. No.: 750,789

[22] Filed: Aug. 27, 1991

[51] Int. Cl.[5] ..... B21B 31/08

[52] U.S. Cl. ..... 29/130; 29/132

[58] Field of Search ..... 29/130, 132

[56] References Cited

U.S. PATENT DOCUMENTS

| | | | |
|---|---|---|---|
| 3,800,381 | 4/1974 | Brafford | 29/132 |
| 3,936,170 | 2/1976 | Shibano et al. | 29/132 X |
| 4,317,265 | 3/1982 | Chase et al. | 29/132 |
| 4,368,568 | 1/1983 | Watanabe | 29/132 X |
| 4,513,660 | 4/1985 | Brands et al. | 29/132 X |
| 4,586,224 | 5/1986 | Sartor et al. | 29/132 X |
| 4,766,996 | 8/1988 | Gibson | 29/132 X |
| 4,990,963 | 2/1991 | Yamamoto et al. | 29/132 X |
| 5,045,891 | 9/1991 | Senba et al. | 29/130 X |

*Primary Examiner*—Timothy V. Eley

*Assistant Examiner*—C. Richard Martin

*Attorney, Agent, or Firm*—Dirk J. Veneman; Raymond W. Campbell; David J. Archer

[57] ABSTRACT

A roll cover apparatus is disclosed for covering a roll of a papermaking machine. The apparatus includes a synthetic cover which is applied to the outer peripheral surface of the roll, which is of an electrically conductive material. A plurality of fibers are randomly dispersed within the synthetic cover such that the plurality of fibers are disposed between the outer peripheral surface of the roll and an outer face of the synthetic cover. An electrically conductive material is applied to the external boundary of at least some of the fibers such that during use of the apparatus, when slippage occurs between a web of paper being treated by the apparatus and the outer face of the cover, an electrostatic charge generated by the slippage is discharged by the conductive material from the outer face of the cover to the electrically conductive roll so that scorching of the web by discharge of the charge through the web is eliminated.

11 Claims, 1 Drawing Sheet

ROLL COVER APPARATUS

BACKGROUND OF THE INVENTION

1. Field of the Invention

The present invention relates to a roll cover apparatus for covering a roll of a papermaking machine. More particularly, the present invention relates to a roll cover apparatus for a press section or calender section.

2. Information Disclosure Statement

In the papermaking industry, a web of paper from a forming section is typically guided through at least one press nip for removing further quantities of water from the formed web. Such press nips have, in the past, included a pair of counter-rotating steel rolls or a steel roll cooperating with a counter-rotating granite roll or the like.

In certain applications, it has been found advantageous to cover the steel roll with a compliant cover for improving the surface characteristics of the resultant pressed web.

Although various rubber compositions have been used in the fabrication of roll covers, polymeric materials have been used very successfully in the manufacture of such roll covers.

The aforementioned polymeric materials may be reinforced with woven or non-woven fabric and may comprise single or multiple layers.

Often the outer face of the cover is grooved in order to assist in channeling water away from the press nip.

Additionally, roll covers have been used in the calendering of a web downstream from the press section.

Normally, a web of paper or liner board extends around a plurality of drying cylinders downstream relative to the press section. Subsequently, the dried web extends through a calender for imparting smoothness to the surface of the web. Such smoothing could be likened to the ironing of domestic clothing in order to smooth the surface thereof.

Although many calenders include a stack of counter-rotating steel rolls, more recently, soft calendering has found wide application in the papermaking art.

Soft calendering essentially includes passing a web of paper through a calendering nip defined between a steel surfaced roll and a compliant cover of a mating roll.

In both the press section and the calendering section of a papermaking machine, a problem has existed in that when even slight slippage occurs between the web of paper and the roll cover, such slippage generates an electrostatic charge on the roll cover surface. Such is particularly a problem in a dry ambient atmosphere.

In order to compensate for the aforementioned generation of such electrostatic charge due to the microslippage between the web and the roll cover, various electrical conductors have been employed for dissipating the electrostatic charge from the surface of the roll cover.

The aforementioned conductors include metallic tinsel or silver paper arranged such that the tinsel bears against the outer surface of the rotating roll cover. Such tinsel conducts an electrical current from the surface of the roll cover so that the cover charge can be dissipated to ground.

However, the silver paper or tinsel is very thin, and in the event of the tinsel breaking away from the main body of the tinsel conductor, not only does such piece of tinsel become attached to the web, but also that portion of the roll cover adjacent to where such breakage occurred is no longer subjected to electrostatic discharge. Consequently, an electrostatic charge can build up on the surface of the roll and such charge can intermittently discharge from the roll cover through the web to ground through the cooperating steel roll of the press or calendering nip.

Such dissipation through the web causes a scorch mark on the web which renders the resultant web unsuitable for printing thereon.

The present invention seeks to overcome the aforementioned disadvantages of the aforementioned proposals by providing electrically conductive fibers and reinforcement randomly dispersed within the roll cover for conducting the current to dissipate the electrostatic charge on the surface through the roll cover to the electrically conductive roll on which the roll cover is formed.

Therefore, it is a primary objective of the present invention to provide a roll cover apparatus that overcomes the aforementioned inadequacies of the prior art proposals and which makes a considerable contribution to the art of dissipating an electrostatic charge on a roll cover.

Other objects and advantages of the present invention will be readily apparent to those skilled in the art by a consideration of the detailed description taken in conjunction with the annexed drawings.

SUMMARY OF THE INVENTION

The present invention relates to a roll cover apparatus for covering a roll of a papermaking machine. The apparatus includes a synthetic cover which is applied to the outer peripheral surface of the roll, the roll being of electrically conductive material.

A plurality of fibers are randomly dispersed within the synthetic cover such that the plurality of fibers are disposed between the outer peripheral surface of the roll and an outer face of the synthetic cover.

An electrically conductive material is applied to the external boundary of at least some fibers of the plurality of fibers such that during use of the apparatus, when slippage occurs between a web of paper being treated by the apparatus and the outer face of the cover, an electrostatic charge generated by the slippage is discharged by the conductive material from the outer face of the cover to the electrically conductive roll so that scorching of the web by discharge of the current through the web is eliminated.

In one embodiment of the present invention, the synthetic cover is of a polymeric material. More particularly, the polymeric material is an epoxy.

Additionally, the percentage of conductive material and its distribution within the epoxy cover is such that the electrical resistance of the cover apparatus is diminished sufficiently to prevent appreciable electrostatic charge build-up.

In one embodiment of the present invention, the fibers are aramid fibers, and in another embodiment, the fibers are ceramic. In either embodiment, the fibers reinforce the synthetic cover.

In a preferred embodiment of the present invention, the electrically conductive material is silver, which is either coated, clad or electro-plated onto the fibers.

In another embodiment of the present invention, the fibers are of an electrically conductive material.

Many modifications and variations of the present invention will be readily apparent to those skilled in the art by a consideration of the detailed description contained hereinafter taken in conjunction with the annexed drawings. However, such modifications and variations do not depart from the spirit and scope of the present invention as defined by the appended claims.

Included in such modifications would be the provision of nickel coated graphite fibers.

BRIEF DESCRIPTION OF THE DRAWINGS

Similar reference characters refer to similar parts throughout the various embodiments of the invention.

DETAILED DESCRIPTION OF THE DRAWINGS

Figure 1:
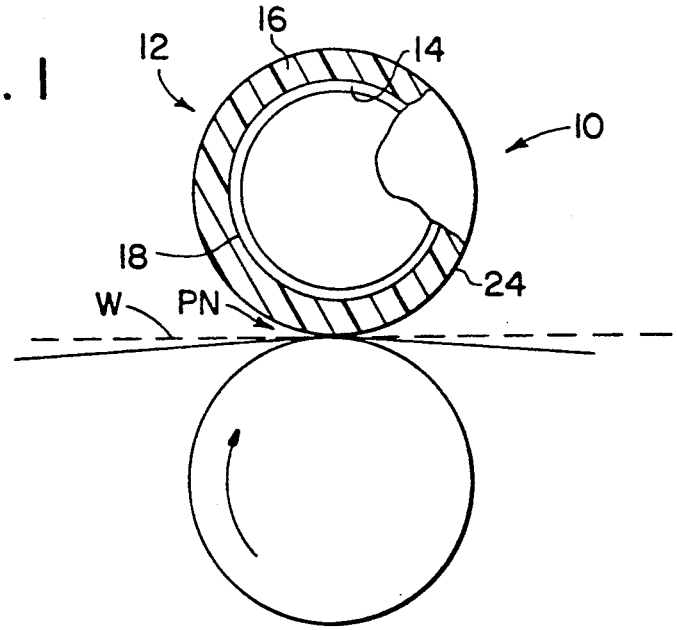
FIG. 1 is a side-elevational view, partially in section, showing a press roll couple with one of the press rolls having a roll cover according to the present invention.

FIG. 1 is a side-elevational view of a roll press couple generally designated 10 incorporating the roll cover apparatus, generally designated 12, according to the present invention. The roll cover apparatus 12 covers a roll 14 of a papermaking machine.

The apparatus includes a synthetic cover 16 which is applied to the outer peripheral surface 18 of the roll 14. The roll 14 is of an electrically conductive material, such as steel or the like.

Figure 2:
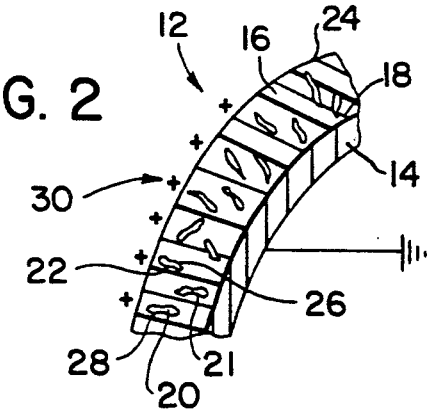
FIG. 2 is an enlarged fragmentary view of the roll cover shown in FIG. 1 showing more clearly the disposition of the fibers within the synthetic cover and the diagrammatic representation of the dissipation of an electrostatic charge from the face of the cover.

FIG. 2 is an enlarged fragmentary view of the roll cover apparatus according to the present invention and shows a plurality of fibers 20,21 and 22 randomly dispersed within the synthetic cover 16 such that the plurality of fibers 20 to 22 are disposed between the outer peripheral surface 18 of the roll 14 and an outer face 24 of the synthetic cover 16.

An electrically conductive material 26 is applied to the external boundary 28 of at least some fibers 20 and 22 of the plurality of fibers 20 to 22 such that during use of the apparatus 12, when slippage occurs between a web of paper W and the outer face 24 of the cover 16, an electrostatic charge 30, generated by the slippage, indicated by a series of +'s, is discharged through the conductive material 26 from the outer face 24 of the cover 16 to the electrically conductive roll 14 so that scorching of the web W by discharge of the current 30 through the web W is eliminated.

More particularly, the synthetic cover 16 is of polymeric material and, specifically, of epoxy.

The percentage of conductive material fibers 20 to 22 and their distribution within the epoxy 16 is such that the electrical resistance of the cover apparatus 12 is diminished sufficiently to prevent appreciable electrostatic charge build-up.

The fibers 20 to 22 in a preferred embodiment of the present invention are aramid fibers.

In an alternative embodiment of the invention, the fibers 20 to 22 are ceramic.

In both embodiments of the present invention, the fibers 20 to 22 reinforce the synthetic cover 16.

The electrically conductive material 26 shown in FIG. 2 is silver which may be either coated, clad or electro-plated onto the fibers 20 and 22.

Figure 3:
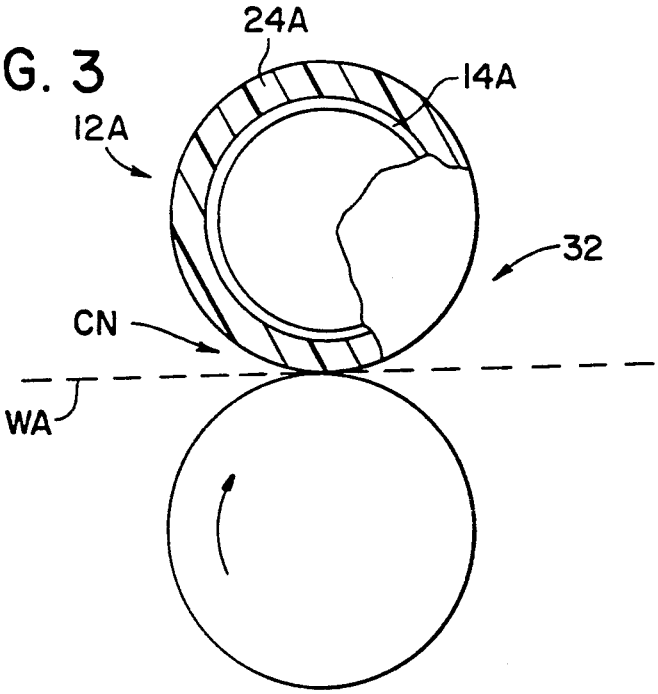
FIG. 3 is a side-elevational view of a further embodiment of the present invention showing, partially in section, a soft calender in which the soft roll includes a roll cover apparatus according to the present invention.

FIG. 3 shows an alternative embodiment of the present invention in which the roll cover apparatus 12A is applied to a roll 14A of a soft calender generally designated 32.

In another embodiment of the present invention, the fibers 20 and 22 are of an electrically conductive material so that such fibers do not require electro-plating or the like.

In operation of the apparatus according to the present invention, the web W extends through either the press nip PN shown in FIG. 1 or through the calender nip CN shown in FIG. 3. In both cases, the electrostatic charge, which builds up on the outer face 24,24A of the roll cover, is dissipated either through the electrically conductive material 26 or through the electrically conductive fibers 20 and 22 so that such charge 30 is dissipated to the roll 14,14A rather than through the web W.

The present invention provides a simple means for removing an electrostatic charge that builds up on a roll cover due to slippage between the roll cover and the web so that scorching of the treated web is eliminated.

What is claimed is:

1. A roll cover apparatus for covering a roll of a papermaking machine, said apparatus comprising:

a synthetic cover which is applied to an outer peripheral surface of the roll, the roll being of electrically conductive material;

a plurality of fibers randomly dispersed within said synthetic cover such that said plurality of fibers are disposed between said outer peripheral surface of the roll and an outer face of said synthetic cover; and an electrically conductive material applied to an external boundary of at least some fibers of said plurality of fibers such that during use of the apparatus, when slippage occurs between a web of paper and said outer face of said cover, an electrostatic charge generated by said slippage is discharged by said conductive material from said outer face of said cover to the electrically conductive roll so that scorching of said web by discharge of said charge through said web is eliminated.

2. A roll cover apparatus as set forth in claim 1 wherein said synthetic cover is of polymeric material.

3. A roll cover apparatus as set forth in claim 2 wherein said polymeric material is epoxy.

4. A roll cover apparatus as set forth in claim 3 wherein the percentage by weight of conductive material fibers and their distribution within the epoxy is such that the electrical resistance of the cover apparatus is diminished sufficiently to prevent appreciable electrostatic charge build-up.

5. A roll cover apparatus as set forth in claim 1 wherein said fibers of said plurality of fibers are aramid fibers.

6. A roll cover apparatus as set forth in claim 1 wherein said fibers are ceramic.

7. A roll cover apparatus as set forth in claim 1 wherein said fibers reinforce said synthetic cover.

8. A roll cover apparatus as set forth in claim 1 wherein said electrically conductive material is silver.

9. A roll cover apparatus as set forth in claim 1 wherein said conductive material is coated onto said fibers.

10. A roll cover apparatus as set forth in claim 1 wherein said electrically conductive material is clad onto said fibers.

11. A roll cover apparatus as set forth in claim 1 wherein said electrically conductive material is plated onto said fibers.

* * * * *